US006423464B1

(12) United States Patent
Kubo et al.

(10) Patent No.: US 6,423,464 B1
(45) **Date of Patent: *Jul. 23, 2002**

(54) LASER ABLATIVE RECORDING MATERIAL

(75) Inventors: Kazuro Kubo; Tadashi Ito, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/027,249

(22) Filed: Feb. 20, 1998

(30) Foreign Application Priority Data

Mar. 3, 1997 (JP) ..... 9-047687

(51) Int. Cl.[7] ..... B41M 5/26

(52) U.S. Cl. ..... 430/200; 430/201; 430/945; 430/961; 430/269.1; 503/227; 156/239

(58) Field of Search ..... 430/200, 201, 430/945, 269.1, 961.1; 503/227; 156/239

(56) References Cited

U.S. PATENT DOCUMENTS 4,268,840 A * 5/1981 Schank et al. ..... 346/135.1
4,707,425 A * 11/1987 Sasagawa et al. ..... 430/945
4,772,582 A * 9/1988 DeBoer ..... 430/201
5,354,633 A * 10/1994 Lewis et al. ..... 430/201
5,429,909 A * 7/1995 Kaszczuk et al. ..... 430/201
5,529,884 A * 6/1996 Tutt et al. ..... 430/200
5,582,669 A * 12/1996 Gove et al. ..... 156/239
5,674,661 A * 10/1997 Neumann ..... 430/200
5,759,741 A * 6/1998 Pearce et al. ..... 430/200
6,124,075 A * 9/2000 Ishihara et al. ..... 430/200
6,261,739 B1 * 7/2001 Ito et al. ..... 430/270.11

FOREIGN PATENT DOCUMENTS

EP 0 698 503 A1 2/1996 ..... B41M/5/24
JP 07-041501 * 2/1995

OTHER PUBLICATIONS

CAS 140699–47–9 registry file.*

* cited by examiner

*Primary Examiner*—Martin Angebranndt
(74) *Attorney, Agent, or Firm*—Sughrue Mion, PLLC

(57) ABSTRACT

The present invention discloses a laser ablative recording material having at least one coloring agent layer and at least one overcoat layer on a surface of a support, wherein at least one of the overcoat layers contains a non-self-oxidizing, low temperature heat decomposable polymer which, when heated at a rate of 10° C./min, starting at room temperature, decreases in weight by 50% or more before reaching 300° C. This laser ablative recording material is characterized by excellent scratch resistance, a low Dmin, and a very high dye removing efficiency.

15 Claims, No Drawings

LASER ABLATIVE RECORDING MATERIAL

The present invention relates to a laser ablative recording material, and more particularly to an ablative recording material having a low temperature heat decomposable polymer used in an overcoat layer.

Recently, a thermal transfer system forming an image by imparting an electric signal to a thermal print head has become more popular. A method of forming an image by the use of a laser in place of the thermal print head was on the other hand developed, and is expected to become more popular along with the tendency toward a higher laser output.

A recording material for laser recording contains a material having a strong absorption in the laser wavelength region, and this absorbing material converts optical energy into thermal energy, and brings about effects similar to those available by the use of a thermal print head. Use of a laser, unlike the use of a thermal print head, permits heating without contact with a recording material, thus providing an advantage of the image surface free from flaws. Because of the possibility to stop down a laser beam, there is provided another advantage of improving image resolution.

A method for forming an image using a high-output laser known as the dye ablation has recently been developed. Japanese Unexamined Patent Publications Nos. 7-164,755, 7-149,063, and 7-149,065 (corresponding to U.S. Pat. No. 5,330,876, U.S. Pat. No. 5,401,618 and U.S. Pat. No. 5,459,017) disclose recording materials applicable in this method, and Japanese Unexamined Patent Publications Nos. 8-48,053 and 8-72,400 (corresponding to U.S. Pat. Nos. 5,521,629 and 5,574,493) disclose imaging apparatuses used in this method. Image recording based on the ablation method is accomplished by irradiating a laser from a coloring agent layer side onto a recording material having a coloring agent layer comprising a coloring agent, a material having absorption in the laser wavelength region (infrared-absorbing material) and a binder formed on a support. On the spot to which the laser beam has been irradiated, a sharp local change takes place in the coloring agent layer under the effect of energy from the laser, and this drives away the material from the layer. According to the aforesaid patent publications, this local change is not a perfectly physical change such as melting, evaporation or sublimation, but a kind of chemical change such as bond-breaking, and is believed to be a complete, not partial, removal of the coloring agent.

These recording materials used in the dye ablation imaging method have been pointed out as being inferior in scratch resistance to conventional silver halide photographic materials, and their improvements have been demanded. In this view, a method has been provided which improves scratch resistance by laying an overcoat layer containing polytetrafluoroethylene beads on an image forming layer (Japanese Unexamined Patent Publication No. 8-108,622).

However, this method has a certain effect in improving scratch resistance, but has posed the problem of lowering the efficiency of ablation.

Usefulness of the dye ablation imaging method largely depends upon the efficiency of removing the imaging dye upon laser exposure. As a scale representing this efficiency, the minimum density value (Dmin) of the laser exposed area is employed. A lower Dmin points to a higher dye removing efficiency. Thus, it has been desired to provide a laser ablative recording material having high scratch resistance and a low Dmin.

The present invention aims to provide a novel laser ablative recording material which has solved the problem facing a known laser ablative recording material. That is, an object of the invention is to provide a laser ablative recording material having satisfactory scratch resistance, a low Dmin and a high ablation efficiency. Another object of the invention is to provide an image-formed laser ablative record which ensures a high storage stability of an image formed through imagewise heating and easy handling with little image discoloration caused by, for example, fingerprints. Other objects of the invention would be easily understood from the entire description of this specification by a person skilled in the art.

We, the inventors, have conducted extensive studies in an attempt to attain the foregoing objects. As a result, we have found that a recording medium with a low Dmin and a high ablation efficiency can be provided by incorporating a low temperature heat decomposable polymer into an overcoat layer. This finding has led us to accomplish the present invention.

That is, the invention provides a laser ablative recording material having at least one coloring agent layer and at least one overcoat layer on a surface of a support, wherein at least one of the overcoat layers contains a non-self-oxidizing, low temperature heat decomposable polymer which, when heated at a rate of 10° C./min, starting at room temperature, decreases in weight by 50% or more before reaching 300° C.

According to a preferred embodiment of the invention, at least one of the overcoat layers contains a non-self-oxidizing, low temperature heat decomposable polymer which, when heated at a rate of 10° C./min, starting at room temperature, decreases in weight by 50% or more at a temperature in the range of from 100 to 300° C. The content of the low temperature heat decomposable polymer is preferably 0.1 to 5 $g/m^2$.

According to another preferred embodiment of the invention, at least one of the overcoat layers contains polytetrafluoroethylene beads. Particularly preferably, at least one of the overcoat layers contains 0.005 to 5.0 $g/M^2$ of polytetrafluoroethylene beads having a particle size of 0.1 to 20 $\mu$m.

According to still another preferred embodiment of the invention, the coefficient of dynamic friction of the overcoat layer is 0.15 or less, more preferably 0.10 or less.

According to a further preferred embodiment of the invention, the coloring agent layer contains a pigment or inorganic fine particles. Particularly preferably, the coloring agent layer contains carbon black.

According to a still further preferred embodiment of the invention, the coloring agent layer contains cellulose nitrate or nitric ester of carboxyalkyl cellulose. Preferably, the nitric ester of carboxyalkyl cellulose has a degree of nitric ester group substitution per glucose anhydride unit within the range of from 0.2 to 2.2, and has a degree of carboxyalkyl ether group substitution per glucose anhydride unit of 0.05 to 1.5.

According to an additional preferred embodiment of the invention, the ablation recording material has at least one intermediate layer between the support and the coloring agent layer. The intermediate layer preferably contains a material having absorption in the laser wavelength region.

According to a further additional preferred embodiment of the invention, the ablation recording material has a back layer on the surface of the support on the opposite side to the coloring agent layer. Preferably, the Beck smoothness of the outermost layer surface of the back layer is 4,000 seconds or less.

The laser ablative recording material preferably has a minimum recording density (Dmin) after laser irradiation of 0.11 or less.

The invention also provides a laser ablative image-formed record prepared by irradiating a laser onto the laser ablative recording material of the invention. Particularly preferred is a laser ablative image-formed record prepared by providing a withstanding layer on a surface on the coloring agent layer side after laser irradiation.

Now, the laser ablative recording material and the laser ablative image-formed record of the invention will be described in detail below.

For the overcoat layer of the laser ablative recording material of the invention, a low temperature heat decomposable polymer is used as a polymeric binder. This low temperature heat decomposable polymer has to be a non-self-oxidizing polymer which, when heated at a rate of 10° C./min, starting at room temperature, decreases in weight by 50% or more before reaching 300° C. Preferred is a non-self-oxidizing polymer which decreases in weight by 50% or more at a temperature between 100 and 300° C. The decrease in weight when heated at a rate of 10° C./min, starting at room temperature, can be measured, for example, within the range of from room temperature to 500° C. by means of a DTA/TG measuring instrument (SSC/5200; made by SEIKO Denshi Kogyo Co.).

The amount of the binder coated for the overcoat layer is preferably in the range of from 0.1 to 5 g/m$^2$, and more preferably in the range of from 0.1 to 2 g/m$^2$.

The type of the low temperature heat decomposable polymer used for the overcoat layer is not restricted, as long as it is a non-self-oxidizing polymer which, when heated at a rate of 10° C./min, starting at room temperature, decreases in weight by 50% or more before reaching 300° C. Typical examples of the preferred low temperature heat decomposable polymer are presented below, but other polymers may be used.

(n is preferably 50–10,000, more preferably 100–5,000)

Beads may be contained in the overcoat layer. Particularly, polytetrafluoroethylene beads should preferably be contained. The use of polytetrafluoroethylene beads is effective in improving scratch resistance and wear resistance, and in performing mat finish for decreasing fingerprint adhesion and glare, as is disclosed in Japanese Unexamined Patent Publication No. 8-108,622.

The particle size and the coating amount of polytetrafluoroethylene beads can be set within ranges effective for achieving the intended objects. In general, the particle size should preferably be within the range of from about 0.1 to about 20 μm, or more preferably from 0.1 to about 5 μm. The coating amount is generally within the range of from about 0.005 to about 5.0 g/m$^2$, or preferably within the range of from about 0.05 to about 0.5 g/m$^2$. Polytetrafluoroethylene beads are not necessarily required to be spherical in shape, but may be in an arbitrary shape.

In the present invention, the coefficient of dynamic friction of the overcoat layer is preferably 0.15 or less, or more preferably 0.10 or less. The coefficient of dynamic friction (μk) can be determined by the same principle as that for the method of testing the coefficient of dynamic friction described in the JIS K7125. That is, a silver halide photosensitive material is left to stand for more than 1 hour under the conditions 25° C. and relative humidity 60%. Then, a steel ball with a diameter of, say, 0.5 to 5 mm is slid on the surface of a laser ablation recording material at a certain

B-1

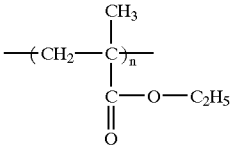

B-2

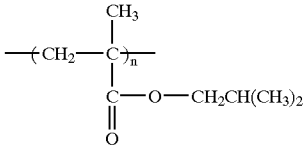

B-3

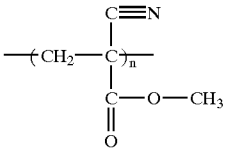

B-4

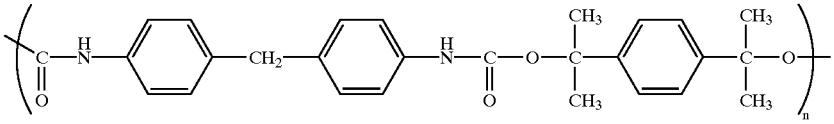

B-5

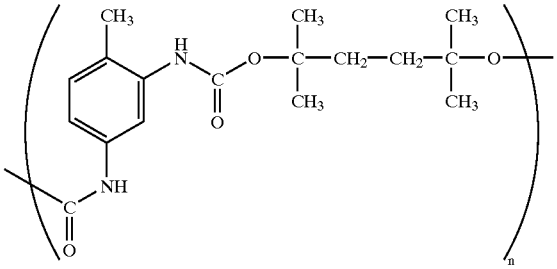

B-6

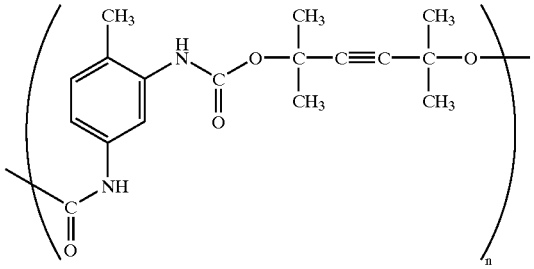

speed (e.g. 20–100 cm/min) under a certain load (contact force Fp: e.g. 50–200 g). The tangential force Fk in this case is measured, and based on its value, the coefficient of dynamic friction can be obtained from the equation give below. The measurement can be made using, for instance, a surface property measuring device (HEIDEN-14; made by Shinto Kagaku Co.).

$$\mu_k = \frac{F_k}{F_p}$$

At least one coloring agent layer is provided in the recording material of the invention. A pigment, an inorganic particulate or a dye is used as a coloring agent in the coloring agent layer. Preferable pigments and inorganic particulates include organic pigments such as azo dyes, lake pigments, azine compounds, etc., carbon black, graphite, titanium black, metal phthalocyanine, metal oxides such as titanium oxide, and colloidal silver.

When using the recording material for manufacturing a printing plate, the pigment or the inorganic particulate used is required to have absorption in the UV region. When it is used for medical purposes, the pigment or the inorganic particulate used should be black in color. The particle size which gives a color of the pigment or the inorganic particulate, which largely varies with circumstances, should preferably be within a range of from 5 to 500 nm, or more preferably, from 5 to 250 nm.

The amount of coated pigment or inorganic particulate should be within a range in which the laser non-irradiated portion has absorption of a concentration of over 2.5 (absorption value in the UV region for printing purposes, and absorption value in the visible region for medical purposes). In general, the coating amount varies with the kind or size of inorganic particulate used. For example, when coating carbon black (particle size: 24 nm) in a coating amount of 0.67 g/m$^2$, there are obtained a UV concentration of 4.0 and a visible concentration of 2.7. Colloidal silver (particle size: 20 nm), if coated in a coating amount of 0.5 g/m$^2$, leads to a UV concentration of 3.5 and a visible concentration of 0.4.

Use of a pigment or an inorganic particulate having absorption in the laser wavelength region is preferable because of the simultaneous availability of two functions including a laser wavelength absorbing material and a coloring agent. More specifically, this is favorable in that the necessity of individually preparing a laser wavelength absorbing material and a coloring agent is eliminated or alleviated.

There is no particular limitation imposed on the method of manufacturing a pigment or an inorganic particulate used in the invention so far as manufacture of the foregoing particle size is permitted. For example, the channel method, the thermal method and the furnace method disclosed in Donnel Voet, "Carbon Black" Marcel Dekker, Inc. (1976) are applicable for a carbon black material.

A dye of any kind may be used for the coloring agent layer of the invention so far as it permits ablation by laser irradiation. For example, dyes disclosed in U.S. Pat. Nos. 4,541,830, 4,698,651, 4,695,287, 4,701,439, 4,757,046, 4,743,582, 4,769,360, and 4,753,922, which are hereby incorporated by reference can by appropriately applied. These dyes may be used either alone or in combination. These dyes may be used in a coating amount within a range of from about 0.05 to about 1 g/m$^2$.

Wide variety of binders may be used in the coloring agent layer side of the recording material of the invention provided that the components of the layers are dispersed in the binders. Preferable binders are decomposable polymers which are quickly pyrolized by heat generated from laser irradiation and gives a gas in a sufficient quantity and a volatile fragment, or a decomposable polymer of which the decomposition temperature considerably decreases in the present of a slight amount of an acid. Preferable ones of such decomposable polymer include those having a polystyrene equivalent molecular weight of over 100,000 as measured by size-excluded chromatography disclosed in U.S. Pat. No. 5,330,876 which is hereby incorporated by reference (F. W. Billmeyer, "Textbook of Polymer Science", 2nd ed., 53–57).

Particularly preferable binders for the coloring agent layer side of the recording material of the invention are nitric esters of carboxyalkyl cellulose and cellulose nitrate. Nitric esters of carboxyalkyl cellulose are prepared by reacting a carboxy alkylcellulose such as carboxymethyl cellulose and hydroxyethyl cellulose with a mixed acid for nitric esterization comprising for example sulfuric acid, nitric acid and water to achieve a degree of nitric ester group substitution in the carboxyalyl cellulose of at least 0.2 and a degree of carboxyalkyl ether group substitution of at least 0.05. Examples of the nitric esters of carboxyalkyl cellulose include the aqueous cellulose derivatives disclosed in Japanese Unexamined Patent Publications Nos.5-39301 and 5-39302 which are hereby incorporated herein by reference.

The nitric esters of carboxyalkyl cellulose used in the invention preferably have a degree of nitric ester group substitution within the range of from 0.2 to 2.2 and a degree of carboxyalkyl ether group substitution within the range of from 0. 05 to 1.5. A degree of nitric ester group substitution of under 0.2 is not desirable because of insufficient dispersibility and water resistance of a developer and a dye. A degree of carboxyalkyl ether group substitution of under 0.05 leads to an insufficient solubility in water, as to practical impossibility to use the same as a water-soluble binder.

A degree of nitric ester group substitution of over 2.2 is not desirable because of the necessity of increasing the consumption of an organic solvent to dissolve or disperse the same in a mixed solvent of water and an organic solvent. A degree of carboxyalkyl ether group substitution of over 1.5 tends to a slightly insufficient water resistance of the coated surface. Carboxyl group of nitric ester of carboxyalkyl cellulose used in the invention may be partially or totally neutralized. Neutralization increases solubility into water and a water-soluble organic solvent mainly comprising water. For the purpose of neutralizing the carboxyl group, one or more of an alkali metal ion, an alkali earth metal ion, ammonium ion and a cation of an organic amine or the like may be used. The extent of neutralization, depending upon the chemical composition of the target solution including water and organic solvent contents, should preferably be in general such that 50% or more of carboxyl group are neutralized.

In the recording material of the invention, a nitric ester of carboxyalkyl cellulose and cellulose nitrate may be used either alone or in combination with at least one of known binders. Examples of the known binders include cellulose derivatives such as carboxymethyl cellulose and hydroxyethyl cellulose, and polymers such as polyvinyl alcohol, carboxy-denatured polyvinyl alcohol, polyvinyl pyrrolidone, polyacrylic acid, polyacrylamide and gelatine, but are not limited to those enumerated above. Latex-based binders such as styrenebutadiene latex and urethane latex may also be used.

The laser ablative recording material of the invention preferably a intermediate layer between the support and the coloring agent layer. The intermediate layer preferably contains a material having absorption in the laser wavelength region. Such an intermediate layer can reduce Dmin of the laser-irradiated portion and increase the ablation efficiency.

Any binders which can be used in the coloring agent layer can be used in the intermediate layer either alone or in combination. The amount of coated binder should be determined to reduce Dmin as possible, preferably be within a range of from 0.05 to 2 g/m$^2$, more preferably from 0.1 to 1.5 g/m$^2$. When the intermediate layer is to have a function of a primer layer to improve close contact with the support, the amount of coated binder should preferably be within a range of from 0.05 to 0.5 g/m$^2$.

The laser ablative recording material of the invention contains a material having absorption in the laser wavelength region. The material having absorption in the laser wavelength region may be contained in the coloring agent layer, or in the intermediate layer present between the support and the coloring agent layer, or in the layer on the coloring agent layer.

When the irradiated laser is an infrared laser, the material having absorption in the laser wavelength region should be an infrared-absorbing material. The amount of coated infrared-absorbing material should have a laser wavelength absorbance of over 0.5, or preferably, over 1.0, or more preferably, over 1.5. Applicable infrared-absorbing materials include, for example, carbon black, cyanic infrared-absorbing dye disclosed in U.S. Pat. No. 4,973,572, and materials disclosed in U.S. Pat. Nos. 4,948,777, 4,950,640, 4,950,639, 4,948,776, 4,948,778, 4,942,141, 4,952,552, 5,036,040, 4,912,083, 5,360,694, 5,380,635 and JPA No. 8-189,817. These patent publications are hereby incorporated by reference.

Typical examples of infrared-absorbing material suitably applicable for the laser ablative recording material of the invention are presented below. Infrared-absorbing materials applicable for the laser ablative recording material of the invention are not however limited to those enumerated below.

(1)

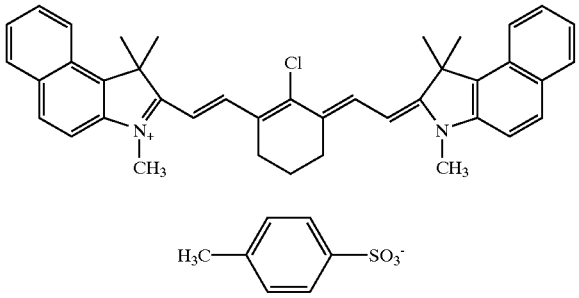

(2)

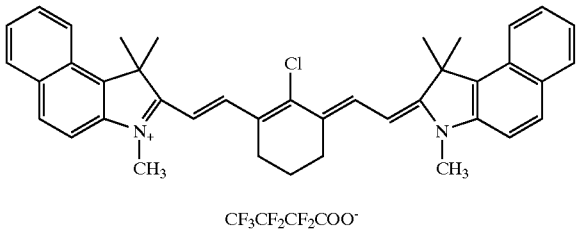

-continued (3)

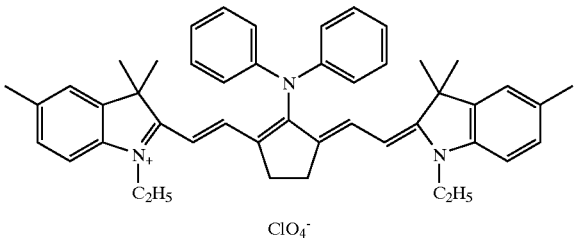

(4)

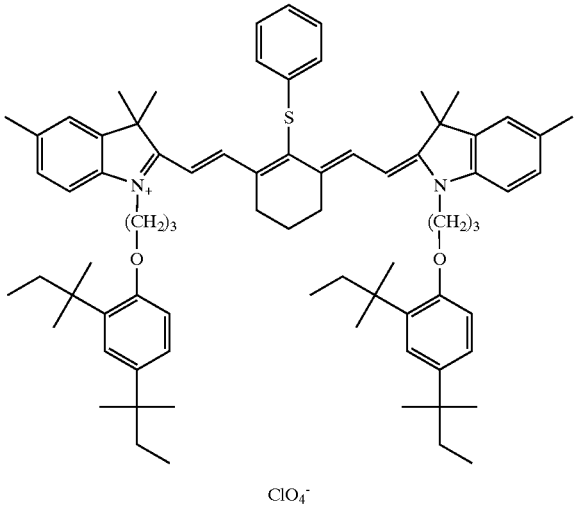

(5)

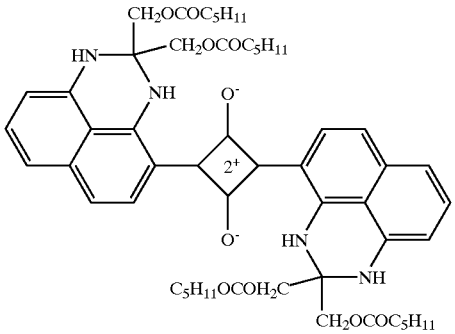

(6)

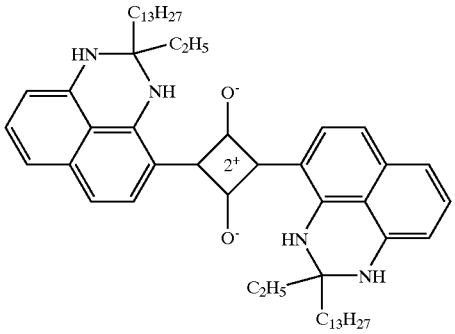

-continued (7)

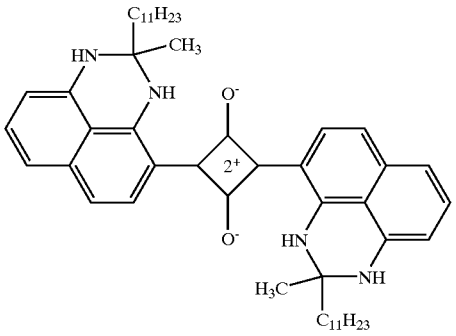

A backcoat layer may be provided in the laser ablative recording material of the invention. The backcoat layer may be formed on the surface of the support on the opposite side to the coloring agent layer.

From the point of view of adhesivity and strippability between recording materials, the outermost layer surface of the backcoat layer should preferably have a Beck smoothness of up to 4,000 seconds, or more preferably, within a range of from 10 to 4,000 seconds. Beck smoothness can be easily determined in accordance with the Japanese Industrial Standard (JIS) P8119 "Smoothness Testing Method of Paper and Cardboard by Beck Tester" and the TAPPI Standard Method T479.

Beck smoothness can be controlled by adjusting the average particle size and the quantity of addition of a matting agent to be contained in the overcoat layer of the backcoat layer. In the invention, the matting agent should preferably have an average particle size of up to 20 $\mu$m, or more preferably, within a range of from 0.4 to 10 $\mu$m. The quantity of added matting agent should preferably be within a range of from 0.5 to 400 mg/m$^2$, or more preferably, from 1.0 to 200 mg/m$^2$.

As the matting agent used in the invention, any solid particles may be used so far as they do not cause a problem in handling, and may be either inorganic or organic. Examples of inorganic matting agent include silicon dioxide, titanium and aluminum oxides, zinc and calcium carbonates, barium and calcium sulfates, and calcium and aluminum silicates. Applicable organic matting agents include organic polymers such as cellulose esters, polymethylmethacrylate, polystyrene and polydivinylbenzene and copolymers thereof.

In the invention, it is desirable to use a porous matting agent disclosed in Japanese Unexamined Patent Publication No. 3-109,542, page 2, left lower column, line 8 through page 3, right upper column, line 4, an alkali surface-modifying matting agent disclosed in Japanese Unexamined Patent Publication No. 4-127,142, page 3, right upper column, line 7 through page 5, right lower column, line 4, or an organic polymer matting agent 11 disclosed in Japanese Patent Application No. 4-265,962, paragraph Nos. [0005] to [0026]. These patent publications and application are hereby incorporated by reference.

These matting agents may be used either alone or two or more thereof in combination. Manners of simultaneous use of two or more matting agents include simultaneous use of an inorganic matting agent and an organic matting agent, simultaneous use of a porous matting agent and a non-porous matting agent, simultaneous use of an amorphous matting agent and a spherical matting agent, and simultaneous use of matting agents with different average particle sizes (for example, simultaneous use of a matting agent having an average particle size of at least 1.5 $\mu$m disclosed in Japanese Patent Application No. 4-265,962 which is hereby incorporated by reference and a matting agent having an average particle size of up to 1 $\mu$m).

A conductive layer having a surface resistance of up to $10^{12}\Omega$ at 25° C. and 30% RH is preferably provided in the recording material of the invention. The conductive layer may be provided either on the coloring agent layer side of the support or on the backcoat layer side. A single conductive layer or two or more such layers may be provided. Further, the conductive layer may be prepared by adding a conductive material to a layer having other functions such as a surface protecting layer, a backcoat layer or a primer layer.

The conductive layer can be formed by coating a coating solution containing a conductive metal oxide or a conductive polymeric compound.

As a conductive metal oxide, it is desirable to use crystalline metal oxide particles. Among others, a particularly preferable one is a conductive metal oxide containing an oxygen defect or containing exotic atom in a slight amount, which forms a donor to the metal oxide used, which has in general a high conductivity. Applicable metal oxides include ZnO, $TiO_2$, $SnO_2$, $Al_2O_3$, $In_2O_3$, $SiO_2$, MgO, BaO, $MoO_3$ and $V_2O_5$ and composite oxides thereof. Particularly, ZnO, $TiO_2$ and $SnO_2$ are preferable. Effective examples containing an exotic atom include ZnO containing added Al, In or the like, $SnO_2$ containing added Sb, Nb or a halogen element, and $TiO_2$ containing added Nb, Ta or the like. The quantity of addition of the exotic atom in these cases should preferably be within a range of from 0.01 to 30 mol %, or more preferably, from 0.1 to 10 mol %.

The metal oxide particulate used in the invention should preferably be conductive and have a volume resistivity of up to $10^7$ Ω·cm, or more preferably, up to $10^5$ Ω·cm. These oxides are disclosed in Japanese Unexamined Patent Publications Nos. 56-143,431, 56-120,519 and 58-62,647 which are hereby incorporated by reference.

A conductive material prepared by causing the aforesaid metal oxides to adhere to other crystalline metal oxide particles or a fibrous material (titanium oxide, for example) may also be used, as is disclosed in Japanese Examined Patent Publication No. 59-6,235 which is hereby incorporated by reference.

The conductive material used in the invention should preferably have a particle size of up to 10 $\mu$m, or more preferably, up to 2 $\mu$m with a view to ensuring stability after dispersion. In order to achieve the lowest possible light scattering, it is desirable to use conductive particles having a particles size of up to 0.5 $\mu$m. Use of such conductive particles permits maintenance of transparency of the support by providing a conductive layer.

When the conductive material is acicular-shaped or fibrous, the material should preferably have a length of up to 30 $\mu$m and a diameter of up to 2 $\mu$m, or more preferably, a length of up to 25 $\mu$m and a diameter of up to 0.5 $\mu$m, with a length/diameter ratio of at least 3.

Preferable conductive polymeric compounds applicable in the invention include polyvinylbenzenesulfonic salts, polyvinylbenziltrimethylammonium chloride, grade-4 polymers as disclosed in U.S. Pat. Nos. 4,108,802, 4,118,231, 4,126,467, and 4,137,217 which are hereby incorporated by reference, and polymer latexes as disclosed in U.S. Pat. No. 4,070,189, West German Unexamined Patent Publication No. 2,830,767, Japanese Unexamined Patent Publications Nos. 61-296, 352 and 61-62,033.

Some concrete examples of the conductive polymeric compound of the invention are enumerated below. Conductive materials applicable in the invention are not however limited to those presented below. The composition of the following polymers is expressed in percentage of polymerization.

E-1

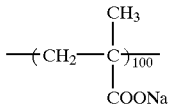

E-2

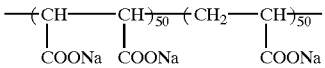

E-3

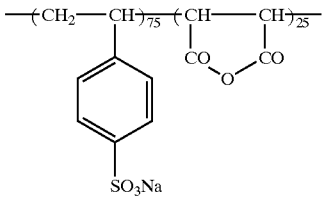

E-4

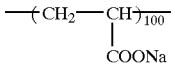

E-5

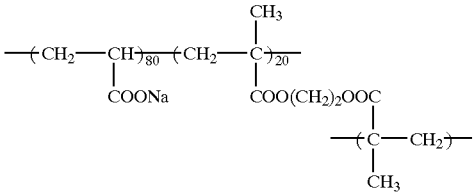

E-6

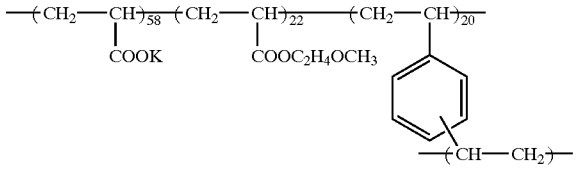

E-7

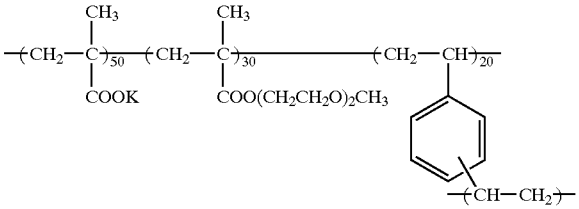

The conductive metal oxide or the conductive polymeric compound is used for forming a conductive layer after dispersing or dissolving in a binder.

The binder used for dispersing or dissolving the conductive metal oxide or the conductive polymeric compound is not particularly limited so far as a film-forming ability is available. For example, applicable binders include protein such as gelatine and casein, cellulose compounds such as carboxymethyl cellulose, hydroxyethyl cellulose, acetyl cellulose, diacetyl cellulose, and triacetyl cellulose, dextran, agar, soda alginate, saccharides such as starch derivatives, and synthetic polymers such as polyvinyl alcohol, polyvinyl acetate, polyacrylic ester, polymethacrylic ester, polystyrene, polyacrylamide, poly-N-vinylpyrrolidone, polyester, polyvinyl chloride, and polyacrylic acid.

Particularly preferable ones include gelatine (lime-treated gelatine, acid-treated gelatine, enzyme-decomposed gelatine, phthalized gelatine, acetylated gelatine, etc.), acetylcellulose, diacetylcellulose, triacetylcellulose, polyvinyl acetate, polyvinyl alcohol, polyacrylic butyl, polyacrylamide, and dextran.

In order to effectively reduce resistance of the conductive layer, a higher volume content of the conductive metal oxide or the conductive polymeric compound is more preferable. However, a binder content of under 5% leads to a lower strength of the conductive layer, and is therefore undesirable. The volume content of the conductive metal oxide or the conductive polymeric compound should therefore preferably be set within a range of from 5 to 95%.

The consumption of the conductive metal oxide or the conductive polymeric compound per $m^2$ of the recording material of the invention should preferably be within a range of from 0.05 to 20 $g/m^2$, or more preferably, from 0.1 to 10 $g/m^2$. To impart a satisfactory antistatic property, the surface resistivity of the conductive layer should be up to $10^{12}\Omega$ under conditions including 25° C. and 30% RH, or more preferably, up to $10^{11}\Omega$.

A better antistatic property can be imparted by simultaneously using a fluorine-containing surfactant in addition to the foregoing conductive material. As the fluorine-containing surfactant used in the conductive layer, a surfactant may have a fluoroalkyl group, an alkenyl group or an aryl group having a carbon number of at least 4, and as an ionic group, an anion group (sulfonic acid (salt), sulfuric acid (salt), carboxylic acid (salt), phosphoric acid (salt)) a cation group (amine salt, ammonium salt, aromatic amine salt, sulfonium salt, phosphonium salt), betaine group (carboxyamine salt, carboxyammonium salt, sulfoamine salt, sulfoammonium salt, phosphoammonium salt) or a nonion group (substituted, non-substituted polyoxyalkylene group, polyglyceril group or sorbitan residue). These fluorine-containing surfactants are disclosed in Japanese Unexamined Patent Publication No. 49-10,722, British Patent No. 1,330,356, U.S. Pat. Nos. 4,335,201, 4,347,308, B.P. No. 1,417,915, Japanese Unexamined Patent Publication No. 55-149,938, 58-196,544, and B.P. No. 1,439,402 which are hereby incorporated by reference.

Examples of the fluorine-containing surfactant applicable in the conductive layer are enumerated below.

F-1

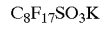

F-2

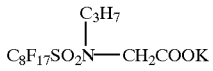

F-3

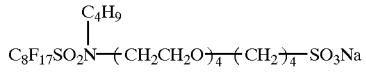

F-4

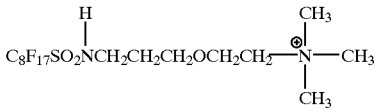

F-5

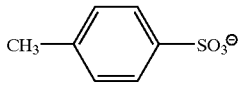

As the support in the recording material of the invention, any material may be used so far as it has a size stability and can withstand heat produced by laser irradiation. Materials applicable as a support include polyesters such as poly (ethylene naphthalate) and poly (ethylene terephthalate); polyamide; polycarbonate; cellulose esters such as cellulose acetate; fluoro-polymers such as poly(vinylidene fluoride) and poly(tetrafluoro-ethylene-co-hexafluoropropylene; polyethers such as polyoxymethylene; polyacetal; polyolefins such as plystyrene, polyethylene, polypropylene and methylpentenpolymer; and polyimides such as polyimide and polyetherimide. The thickness of the support, not particularly limited, should usually be within a range of from about 5 to about 200 $\mu$m.

As required, a primer layer as disclosed in U.S. Pat. Nos. 4,695,288 and 4,737,486, which are hereby incorporated by reference, may be coated onto the support.

An image can be recorded on the recording material of the invention in accordance with an ordinary laser ablation recording method. In the present invention, image forming based on the single sheet method is possible without the necessity of a receiving material since laser irradiation is accomplished from the coloring agent layer side.

The ablative recording material of the invention should have a Dmin of up to 0.11 after laser irradiation, as is described in Japanese Unexamined Patent Publication No. 8-48,053. With a Dmin of up to 0.11, a luster line recognizable by naked eyes is largely eliminated. In order to achieve a Dmin of up to 0.11, the laser beam intensity for writing produced by the laser diode onto the recording material should preferably be at least 0.1 mW/$\mu$m$^2$.

In order to form a laser ablative image on the recording material of the invention, it is desirable to use an infrared diode laser having light emission at above 700 nm. Such a diode laser has practical advantages in that it is compact in size, low in cost, has high stability and reliability, is robust and permits easy modulation.

Laser ablation recording onto the recording material of the invention can be conducted with the use of a commercially available laser irradiating apparatus. Applicable such apparatuses include the laser model SDL-2420-H2 of Spectra Diode Labs., and the laser model SLD304 V/W of Sony Corporation).

When a laser is irradiated onto the recording material of the invention, the material is partially ablated from the support and is scattered into the surrounding open air. The ablated material may gather around the laser apparatus, or accumulate on the portion written with laser. This dump shuts off the laser beam, causes Dmin to increase over the allowable level, and may thus make the image quality degraded to become impracticable. To cope with such a problem, it is desirable to simultaneously use an apparatus for removing the ablated material with an air flow. An example of such a removing apparatus is disclosed in Japanese Unexamined Patent Publication No. 8-72,400 which is hereby incorporated by reference.

A laser ablative record with an image formed by laser irradiation onto the recording material of the invention should preferably be subjected to a treatment for increasing durability of the image. For example, a protecting layer may be formed on the surface of the coloring agent layer side for the protection of the image.

The protecting layer may be formed by the use of an image protecting laminated sheet disclosed in Japanese Unexamined Patent Publication Nos. 5-504,008 and 6-344,676, which are hereby incorporated by reference. This image protecting laminated sheet has a support and a substantially transparent and wear-resistant withstanding layer (protecting layer), and the support and the withstanding layer are bonded together by a weak bonding layer formed therebetween. In application, the withstanding layer of the image protecting laminated sheet is first placed fact to face with the image of the recording material, and after bonding of the surfaces of the withstanding layer and the recording material, the support of the image protecting laminated sheet is stripped off. By doing so, a withstanding layer is formed on the surface of the recording material and plays a role of a protecting layer. Particularly, when adopting the protecting layer forming method disclosed in Japanese Unexamined Patent Publication No. 6-344,676 which is hereby incorporated by reference, the protecting layer never peels off even by repeatedly using a strong adhesive tape upon printing or repeatedly washing the image.

A typical example of the material for the protecting layer used in the invention is a polymeric organic material containing siloxane as disclosed in Japanese Unexamined Patent Publication No. 6-344,676 which is hereby incorporated by reference. A siloxane-containing polymeric material can be prepared, for example, through co-polymerization of an organic monomer or oligomer functionalized with a vinylether group and a siloxane monomer or oligomer. One prepared by any other method is also applicable. The protecting layer on the image has usually a thickness of up to 30 $\mu$m, and in order to prevent an excessive decrease in resolution, the thickness should preferably be up to 10 $\mu$m, or more preferably, within a range of from 0.5 to 6 $\mu$m.

The laser ablative record having an image formed by irradiating a laser onto the recording material of the invention may be stored or used directly for record, or used as a printing plate for printing purposes or as a film for printing. The areas of application thereof widely cover diverse and various fields including press printing, printing for facsimile output, various commercial prints, and medical images. Either a positive or a negative image maybe selected and formed on the recording material of the invention in response to the purpose of use, A person skilled in the art could appropriately select a support of the recording material and a material for the coloring agent for the recording material of the invention, depending upon a particular object of application.

EXAMPLES

Now, the present invention will be described further in detail by means of examples. The chemical compositions, the ratios and the procedures shown in the following examples may be appropriately modified within the scope not deviating from the spirit of the present invention. The scope of the present invention is not therefore limited by the following examples.

In the Examples, there were prepared the recording material of the present invention containing in an overcoat layer a non-self-oxidizing, low temperature heat decomposable polymer which, when heated at a rate of 10° C./min, starting at room temperature, decreases in weight by 50% or more before reaching 300° C., and a control recording material not containing the low temperature heat decomposable polymer in an overcoat layer. Their Dmin's were compared.

A binder A solution used in the Examples is a 15% solution of nitric ester of carboxymethyl cellulose (acetone: 35%; water: 50%; pH adjusted to 6.6 by the use of ammonia water) having a degree of nitric ester group substitution of 2.1 and a degree of carboxymethyl ether group substitution of 0.7 per unit of glucose anhydride.

A binder B solution used in the Examples is a 15% solution of nitric ester of carboxymethyl cellulose (ethanol: 35%; water: 50%; pH adjusted to 5.7 by the use of ammonia water) having a degree of nitric ester group substitution of 2.0 and a degree of carboxymethyl ether group substitution of 0.7 per unit of glucose anhydride.

Dyes D-1, D-2 and D-3 used in the Examples are expressed by the following structural formula:

Dye D-1

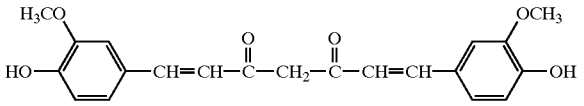

Dye D-2

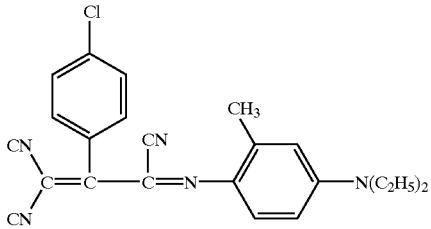

Dye D-3

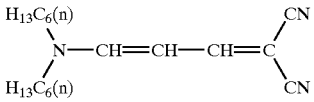

Each recording medium was prepared by coating a first back layer (conductive layer), a second back layer, and a third back layer (lubricating layer) in this order onto one surface of a transparent polyethylene terephthalate support (thickness: 100 μm) which had been biaxially stretched and glow discharge-treated on both sides; and coating an intermediate layer, a coloring agent layer and an overcoat layer in this order onto the opposite surface of the support.

<Formation of First Back Layer (Conductive Layer)>

230 Parts by weight of stannic chloride hydrate and 23 parts by weight of antimony trichloride were dissolved in 3,000 parts by weight of ethanol to prepare a uniform solution. To this solution, a 1N aqueous solution of sodium hydroxide was added dropwise to adjust the pH to 3 and form a colloidal coprecipitate of stannic oxide and antimony oxide. This coprecipitate was allowed to stand for 24 hours at 50° C. to convert it into a red brown colloidal precipitate. The red brown colloidal precipitate was separated by centrifugation, and water was added, followed by centrifugation. This water-washing procedure was repeated 3 times to remove excess ions.

200 Parts by weight of the colloidal precipitate cleared of the excess ions were dispersed in 1,500 parts by weight of water. The resulting dispersion was sprayed onto a firing furnace heated to 500° C. to obtain a stannic oxide-antimony oxide composite as a bluish fine powder. The average particle size of this fine powder was 0.005 μm, and its resistivity was 25 Ω·cm.

40 Parts by weight of the resulting fine powder were mixed with 60 parts by weight of water, and the mixture was adjusted to pH7.0 and coarsely dispersed using a stirrer. Then, the system was dispersed for 30 minutes by means of a horizontal sand mill (Dynomill; made by Willy A. Backfen AG) to prepare a dispersion of a secondary agglomerate (average particle size: 0.05 μm) comprising partially agglomerated primary particles.

The resulting conductive fine particle dispersion was used to prepare a first back layer coating solution having the composition indicated below. This first back layer coating solution was coated onto the surface of the support on the opposite side to the coloring agent layer, and dried for 30 seconds at 110° C. to form a first back layer having a dry thickness of 0.3 μm.

TABLE 1

Composition of first back layer coating solution

| Constituent | Parts by weight |
|---|---|
| Conductive fine particle dispersion above ($SnO_2/Sb_2O_2$:0.15 μm) | 100 |
| Lime-treated gelatin ($Ca^{2+}$ content: 100 ppm) | 10 |
| Water | 270 |
| Methanol | 600 |
| Resorcin | 20 |
| Polyoxyethylene nonylphenyl ether (degree of polymerization: 10) | 0.1 |

<Formation of Second Back Layer>

A second back layer coating solution having the following composition was coated onto the first back layer, and the coating was dried at 110° C. to form a second back layer having a dry thickness of 1.2 μm.

TABLE 2

Composition of second back layer coating solution

| Constituent | Parts by weight |
|---|---|
| Diacetyl cellulose | 100 |
| Trimethylolpropane-3-toluene diisocyanate | 25 |
| Methyl ethyl ketone | 1050 |
| Cyclohexanone | 1050 |

<Formation of Third Back Layer (Lubricating Layer)>

The constituents of the below-described Solution A were mixed and heated to 90° C. to form a solution. This solution was added to Solution B having the below-described composition. The resulting mixture was dispersed by a high pressure homogenizer to obtain a third back layer coating solution. The third back layer coating solution was coated onto the second back layer in a coating amount of 10 ml/m$^2$, and then dried. The Beck smoothness of the third back layer was 500 seconds.

TABLE 3

Composition of third back layer coating solution

| Constituent | Parts by weight |
|---|---|
| [Solution A] | |
| Lubricant: $C_6H_{13}CH(OH)(CH_2)_{10}COOC_{40}H_{61}$ | 0.7 |
| Lubricant: n-$C_{17}H_{35}COOC_{40}H_{81}$ | 1.1 |
| Xylene | 2.5 |
| [Solution B] | |
| Propylene glycol monomethyl ether | 34.0 |
| Diacetyl cellulose | 3.0 |
| Acetone | 600.0 |
| Cyclohexanone | 350.0 |
| Spherical silica matting agent (average particle size: 3.5 μm) | 3.0 |

<Formation of Intermediate Layer>

Any one of intermediate layer coating solutions having the following compositions was coated onto the surface of the support opposite to the back layer in a coating amount of nitric ester of carboxymethyl cellulose of 0.25 g/m$^2$.

TABLE 4

Composition of intermediate layer coating solution

| Intermediate layer | Constituent | Parts by weight |
|---|---|---|
| 1 | Binder A solution | 10.6 |
| | Acetone | 9.4 |
| | Water | 13.4 |
| 2 | Binder A solution | 10.6 |
| | Acetone | 9.4 |
| | Water | 13.4 |
| | Infrared absorbing material (1) | 2.12 |
| 3 | Binder A solution | 10.6 |
| | Acetone | 9.4 |
| | Water | 13.4 |
| | Infrared absorbing material (5) | 2.12 |

<Formation of coloring agent layer>

Any one of coloring agent layer coating solutions prepared by uniformly dispersing individual mixtures of the following compositions by means of a paint shaker was coated onto the intermediate layer. For a coloring agent layer 1, the solution was coated in a coating amount of carbon black of 0.67 g/m$^2$; for a coloring agent layer 2, the solution was coated in a coating amount of titanium black of 0.74 g/m$^2$; for a coloring agent layer 3, the solution was coated in a coating amount of BONTORON N-01 of 1.0 g/m$^2$; for a coloring agent layer 4, the solution was coated in a coating amount of BONTORON S-34 of 1.0 g/m$^2$; and for a coloring agent layer 5, the solution was coated in a coating amount of infrared absorbing material (1) of 0.22 g/m$^2$.

TABLE 5

Composition of coloring agent layer coating solution

| Coloring agent layer | Constituent | Parts by weight |
|---|---|---|
| 1 | Cellulose nitrate (RS: ⅛ sec.; made by Daicel Chemical Ind.) | 5 |
| | Isopropyl alcohol | 2.14 |
| | Methyl isobutyl ketone | 26.6 |
| | Methyl ethyl ketone | 62.0 |
| | Solspers S20000 (made by Zeneca Co.) | 1.35 |
| | Solspers S12000 (made by Zeneca Co.) | 0.23 |
| | Carbon black (particle size: 24 nm) | 5 |
| 2 | Cellulose nitrate (RS: ⅛ sec.; made by Daicel Chemical Ind.) | 5 |
| | Isopropyl alcohol | 2.14 |
| | Methyl isobutyl ketone | 26.6 |
| | Methyl ethyl ketone | 62.0 |
| | Solspers S20000 (made by Zeneca Co.) | 1.35 |
| | Solspers S12000 (made by Zeneca Co.) | 0.23 |
| | Titanium black 12S (particle size: 58 nm; made by Mitsubishi Materials Corp.) | 5.5 |
| 3 | Cellulose nitrate (RS: ⅛ sec.; made by Daicel Chemical Ind.) | 5 |
| | Isopropyl alcohol | 2.14 |
| | Methyl isobutyl ketone | 26.6 |
| | Methyl ethyl ketone | 62.0 |
| | Solspers S20000 (made by Zeneca Co.) | 1.35 |
| | Solspers S12000 (made by Zeneca Co .) | 0.23 |
| | BONTORON N-01 (made by Daicel Chemical Ind.) | 7.5 |
| 4 | Cellulose nitrate (RS: ⅛ sec.; made by Daicel Chemical Ind.) | 5 |
| | Isopropyl alcohol | 2.14 |
| | Methyl isobutyl ketone | 26.6 |
| | Methyl ethyl ketone | 62.0 |
| | Solspers S20000 (made by Zeneca Co.) | 1.35 |
| | Solspers S12000 (made by Zeneca Co.) | 0.23 |
| | BONTORON S-34 (made by Daicel Chemical Ind.) | 7.5 |

TABLE 5-continued

Composition of coloring agent layer coating solution

| Coloring agent layer | Constituent | Parts by weight |
|---|---|---|
| 5 | Cellulose nitrate (1000S; made by Aquaron Co.) | 0.60 |
| | Infrared absorbing material (1) | 0.22 |
| | Dye D-1 | 0.28 |
| | Dye D-2 | 0.16 |
| | Dye D-3 | 0.13 |

<Formation of overcoat layer>

Any one of overcoat layer coating solutions having the following compositions was coated onto the coloring agent layer. The solution was coated in a coating amount of a binder (each of binders B-1 to B-5, polymethyl methacrylate or polyurethane) of 0.25 g/m$^2$.

10 mg of the binder used in each of the overcoat layer coating solutions was measured for changes in weight in the range of from room temperature to 500° C. by means of a DTA/TG measuring instrument (SSC/5200; made by SEIKO Denshi Kogyo Co.) with the temperature raised at a rate of 10° C./min. The temperature at which the weight decreased by 50% was taken as the heat decomposition temperature (Table 7).

TABLE 6

Composition of overcoat layer coating solution

| Overcoat layer | Constituent | Parts by weight |
|---|---|---|
| 1 | Binder B-1 (n = 2,000) | 0.25 |
| | Florene TG710 (made by Kyoeisha Kagaku Co.) | 0.03 |
| 2 | Binder B-1 (n = 2,000) | 0.25 |
| | Polytetrafluoroethylene beads (Zonyl TLP-10F-1; particle size 0.2 μm; made by Mitsui-Du Pont Fluorochemical Co.) | 0.15 |
| | Florene TG710 (made by Kyoeisha Kagaku Co.) | 0.03 |
| 3 | Binder B-3 (n = 2,000) | 0.25 |
| | Polytetrafluoroethylene beads (Zonyl TLP-10F-1; particle size 0.2 μm; made by Mitsui-Du Pont Fluorochemical Co.) | 0.15 |
| | Florene TG710 (made by Kyoeisha Kagaku Co.) | 0.03 |
| 4 | Binder B-4 (n = 100) | 0.25 |
| | Polytetrafluoroethylene beads (Zonyl TLP-10F-1; particle size 0.2 μm; made by Mitsui-Du Pont Fluorochemical Co.) | 0.15 |
| | Florene TG710 (made by Kyoeisha Kagaku Co.) | 0.03 |
| 5 | Binder B-5 (n = 200) | 0.25 |
| | Polytetrafluoroethylene beads (Zonyl TLP-10F-1; particle size 0.2 μm; made by Mitsui-Du Pont Fluorochemical Co.) | 0.15 |
| | Florene TG710 (made by Kyoeisha Kagaku Co.) | 0.03 |
| 6 | Polymethyl methacrylate | 0.25 |
| | Polytetrafluoroethylene beads (Zonyl TLP-10F-1; particle size 0.2 μm; made by Mitsui-Du Pont Fluorochemical Co.) | 0.15 |
| | Florene TG710 (made by Kyoeisha Kagaku Co.) | 0.03 |
| 7 | Polyurethane | 0.25 |
| | Polytetrafluoroethylene beads (Zonyl TLP-10F-1; particle size 0.2 μm; made by Mitsui-Du Pont Fluorochemical Co.) | 0.15 |
| | Florene TG710 (made by Kyoeisha Kagaku Co.) | 0.03 |

TABLE 6-continued

| Composition of overcoat layer coating solution | | |
|---|---|---|
| Overcoat layer | Constituent | Parts by weight |
| 8 | Polyurethane<br>Florene TG710<br>(made by Kyoeisha Kagaku Co.) | 0.25<br>0.03 |

Combinations of the intermediate layer, the coloring agent layer and the overcoat layer for the individual recording materials are as shown in Table 7.

<Exposure Conditions for Image Recording>

Each sample was fixed, with the coloring agent layer side directed outside, to a drum of an image exposure apparatus similar to that disclosed in Japanese Unexamined Patent Publication No. 8-48,053. By the use of a diode laser (SDL-2430; wavelength range: 800 to 830 nm; made by Spectra Diode Labs.) and a lens mounted on a traveling stage of the apparatus, the focus of the laser was aligned with the sample surface (spot size: 10 $\mu$m; half-value width: 7 $\mu$m; focal output: 100 mW). The amount of irradiation on the sample surface was set at 700 mJ/cm$^2$ by adjusting the drum revolutions of the image exposure apparatus. The diode layer mounted on the traveling stage was caused to travel at a speed leading to a center distance of the irradiated beams of 7 $\mu$m.

Coloring agents and binder ablated by the laser were efficiently removed from the sample surface by blowing an air flow during laser irradiation by the use of an apparatus similar to that disclosed in Japanese Unexamined Patent Publication No. 8-72,400.

<Evaluation of Dmax and Dmin in UV Region>

Densities at the laser-non-irradiated area and the laser-irradiated area were measured by means of a densitometer using a UV filter (TD904; made by Macbeth Co.), and the respective measured values were recorded as Dmax (maximum density) and Dmin (minimum density) in the UV region. The results are shown in Table 7.

TABLE 7

| Constituents and results of density measurement of each recording medium | | | | | |
|---|---|---|---|---|---|
| Recording medium No. | Inter-mediate layer No. | Coloring agent layer No. | Overcoat layer No. (Heat decomp. temp. of binder) | Dmax | Dmin |
| 1 | 2 | 1 | None | 4.0 | 0.05 |
| 2 (PI) | 2 | 1 | 1 (280° C.) | 4.0 | 0.06 |
| 3 (PI) | 2 | 1 | 2 (280° C.) | 4.0 | 0.06 |
| 4 (PI) | 2 | 1 | 3 (210° C.) | 4.0 | 0.05 |
| 5 (PI) | 2 | 1 | 4 (220° C.) | 4.0 | 0.05 |
| 6 (PI) | 2 | 1 | 5 (220° C.) | 4.0 | 0.05 |
| 7 | 2 | 1 | 6 (350° C.) | 4.0 | 0.10 |
| 8 | 2 | 1 | 7 (400° C.) | 4.0 | 0.14 |
| 9 | 2 | 1 | 8 (400° C.) | 4.0 | 0.13 |
| 10 | None | 1 | None | 4.0 | 0.09 |
| 11 (PI) | None | 1 | 2 (280° C.) | 4.0 | 0.12 |
| 12 | None | 1 | 7 (400° C.) | 4.0 | 0.24 |
| 13 | 1 | 1 | 7 (400° C.) | 4.0 | 0.20 |
| 14 | 3 | 1 | 7 (400° C.) | 4.0 | 0.16 |
| 15 (PI) | 1 | 1 | 2 (280° C.) | 4.0 | 0.08 |
| 16 (PI) | 3 | 1 | 2 (280° C.) | 4.0 | 0.05 |
| 17 | 2 | 2 | 7 (400° C.) | 3.9 | 0.14 |
| 18 | 2 | 3 | 7 (400° C.) | 3.2 | 0.13 |
| 19 | 2 | 4 | 7 (400° C.) | 3.8 | 0.13 |
| 20 | 2 | 5 | 7 (400° C.) | 3.7 | 0.15 |

TABLE 7-continued

| Constituents and results of density measurement of each recording medium | | | | | |
|---|---|---|---|---|---|
| Recording medium No. | Inter-mediate layer No. | Coloring agent layer No. | Overcoat layer No. (Heat decomp. temp. of binder) | Dmax | Dmin |
| 21 (PI) | 2 | 2 | 2 (280° C.) | 3.9 | 0.06 |
| 22 (PI) | 2 | 3 | 2 (280° C.) | 3.2 | 0.05 |
| 23 (PI) | 2 | 4 | 2 (280° C.) | 3.8 | 0.05 |
| 24 (PI) | 2 | 5 | 2 (280° C.) | 3.7 | 0.06 |

(PI) denotes "present invention"

containing in the overcoat layer the non-self-oxidizing, low temperature heat decomposable polymer which, when heated at a rate of 10° C./min, starting at room temperature, decreases in weight by 50% or more before reaching 300° C. have a low Dmin, pointing to a high dye removing efficiency. Table 7 also shows that the recording media of the invention, which contain in the intermediate layer the infrared absorbing dye having absorption in the laser wavelength region, have a very low Dmin, pointing to an extremely high dye removing efficiency.

<Measurement of Film Strength>

The recording media 1 to 9 were each allowed to stand for 2 hours in an environment of 25° C. and a relative humidity of 60%. Then, a diamond needle 0.025 mm in radius was pressed against the surface of the film on the coloring agent layer side. With the diamond needle being moved at a rate of 10 mm/sec, the load on the needle was continuously varied, and the load (g) imposed when the film broke was measured. The results are given in Table 8.

<Measurement of coefficient of dynamic friction>

The recording media 1 to 9 were each allowed to stand for 1 hour in an environment of 25° C. and a relative humidity of 60%. Then, the tangential force (Fk) was measured at a speed of 60 cm/min under a load (Fp) of 100 g by use of a steel ball with a diameter of 0.5 mm. The measurement was made by means of a surface property measuring device (HEIDEN-14; made by Shinto Kagaku Co.). The coefficient of dynamic friction ($\mu$k) was obtained by calculating (Fk)/(Fp). The results are shown in Table 8.

TABLE 8

| Film strength and coefficient of dynamic friction of each recording medium | | |
|---|---|---|
| Recording medium No. | Film strength (load (g) at film breakage) | Coefficient of dynamic friction |
| 1 | 18 | 0.4 |
| 2 (PI) | 35 | 0.38 |
| 3 (PI) | 85 | 0.08 |
| 4 (PI) | 83 | 0.08 |
| 5 (PI) | 86 | 0.08 |
| 6 (PI) | 85 | 0.08 |
| 7 | 84 | 0.08 |
| 8 | 85 | 0.08 |
| 9 | 30 | 0.39 |

(PI) denotes "present invention"

Table 8 shows that the recording media of the invention using the low temperature heat decomposable polymer as the binder of the overcoat layer have film strength comparable to that of the control recording media using other polymers. This is proof that the use of the low temperature heat decomposable polymer in the overcoat layer does not cause a decrease in film strength. Table 8 also shows that the recording media using polytetrafluoroethylene beads in the overcoat layer are very high in film strength and extremely low in the coefficient of dynamic friction.

What is claimed is:

1. A laser ablative recording material having at least one coloring agent layer and at least one overcoat layer on a first surface of a support, wherein:

said coloring agent layer contains a pigment or inorganic fine particles having absorption in the infrared region, at least one of the overcoat layers contains a non-self-oxidizing, low temperature heat decomposable polymer which, when heated at a rate of 10° C./min, starting at room temperature, decreases in weight by 50% or more before reaching 300° C., said recording material has a back layer on a second surface of the support, said second surface being on the surface opposite to the first surface, and further wherein the Beck smoothness of the outermost layer surface of the back layer is 4,000 seconds or less, and said overcoat layer has a coefficient of dynamic friction of 0.10 or less.

2. The laser ablative recording material according to claim 1, wherein at least one of the overcoat layers contains a non-self-oxidizing, low temperature heat decomposable polymer which, when heated at a rate of 10° C./min, starting at room temperature, decreases in weight by 50% or more at a temperature in the range of from 100 to 300° C.

3. The laser ablative recording material according to claim 1, wherein at least one of the overcoat layers contains 0.1 to 5 g/m$^2$ of the low temperature heat decomposable polymer.

4. The laser ablative recording material according to claim 1, wherein the low temperature heat decomposable polymer is expressed by any of the following structural formulae:

B-1

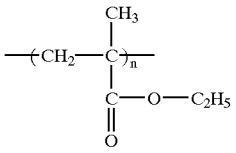

B-2

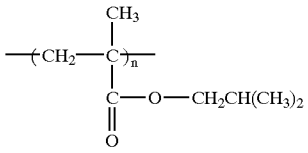

B-3

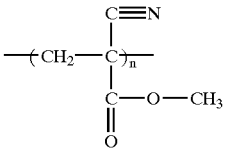

B-4

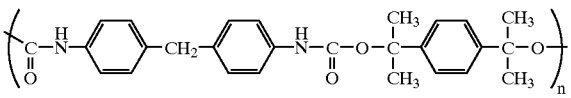

-continued

B-5

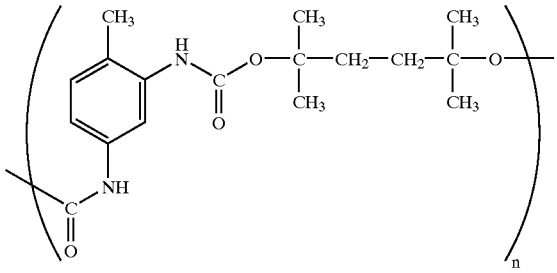

B-6

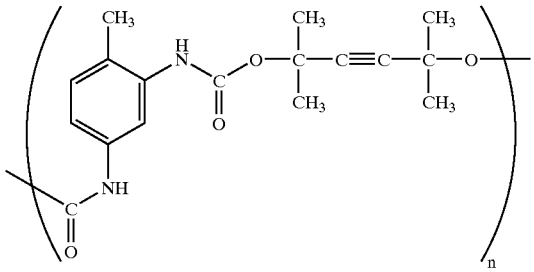

wherein n is 50–10,000.

5. The laser ablative recording material according to claim 1, wherein at least one of the overcoat layers contains polytetrafluoroethylene beads.

6. The laser ablative recording material according to claim 5, wherein at least one of the overcoat layers contains 0.005 to 5.0 g/m$^2$ of polytetrafluoroethylene beads having a particle size of 0.1 to 20 $\mu$m.

7. The laser ablative recording material according to claim 1, wherein the coloring agent layer contains carbon black.

8. The laser ablative recording material according to claim wherein the coloring agent layer contains cellulose nitrate.

9. The laser ablative recording material according to claim 1, wherein the coloring agent layer contains nitric ester of carboxyalkyl cellulose.

10. The laser ablative recording material according to claim 9, wherein the degree of nitric ester group substitution per glucose anhydride unit in the nitric ester of carboxyalkyl cellulose is within the range of from 0.2 to 2.2, and the degree of carboxyalkyl ether group substitution per glucose anhydride unit in the nitric ester of carboxyalkyl cellulose is within the range of from 0.05 to 1.5.

11. The laser ablative recording material according to claim 1, which has at least one intermediate layer between the support and the coloring agent layer.

12. The laser ablative recording material according to claim 11, wherein the intermediate layer contains a material having absorption in the laser wavelength region.

13. The laser ablative recording material according to claim 1, which has a minimum recording density (Dmin) after laser irradiation of 0.11 or less.

14. A laser ablative image-formed record prepared by irradiating a laser onto the laser ablative recording material according to claim 1.

15. The laser ablative image-formed record according to claim 14, which is prepared by providing a withstanding layer on a surface on the coloring agent layer side after laser irradiation.

* * * * *